US009149908B2

(12) United States Patent
Kobayashi et al.

(10) Patent No.: US 9,149,908 B2
(45) Date of Patent: Oct. 6, 2015

(54) SHOT PROCESSING METHOD AND SHOT PROCESSING DEVICE

(71) Applicant: SINTOKOGIO, LTD., Nagoya-shi, Aichi (JP)

(72) Inventors: Yuji Kobayashi, Toyokawa (JP); Akinori Matsui, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 0 days.

(21) Appl. No.: 14/368,373

(22) PCT Filed: Oct. 17, 2012

(86) PCT No.: PCT/JP2012/076856

§ 371 (c)(1),
(2) Date: Jun. 24, 2014

(87) PCT Pub. No.: WO2013/099411

PCT Pub. Date: Jul. 4, 2013

(65) Prior Publication Data

US 2014/0373586 A1 Dec. 25, 2014

(30) Foreign Application Priority Data

Dec. 26, 2011 (JP) ..... 2011-283743

(51) Int. Cl.

| | |
|---|---|
| ***B24C 1/10*** | (2006.01) |
| ***C21D 7/06*** | (2006.01) |
| ***B24B 39/00*** | (2006.01) |
| ***B24C 3/32*** | (2006.01) |
| ***B24C 11/00*** | (2006.01) |

(52) U.S. Cl.

CPC ..... *B24C 1/10* (2013.01); *B24B 39/006* (2013.01); *B24C 3/325* (2013.01); *B24C 11/00* (2013.01); *C21D 7/06* (2013.01)

(58) Field of Classification Search

CPC ..... B24C 1/10; B24C 3/325; B24C 11/00; B24B 39/006; C21D 7/06

See application file for complete search history.

(56) References Cited

U.S. PATENT DOCUMENTS

| | | | | |
|---|---|---|---|---|
| 2,439,032 | A * | 4/1948 | Almen | 29/90.01 |
| 4,713,882 | A * | 12/1987 | Bianchi et al. | 29/727 |
| 5,443,201 | A * | 8/1995 | Cartry | 72/53 |
| 7,647,801 | B2 * | 1/2010 | Cheppe et al. | 72/53 |
| 8,256,117 | B2 * | 9/2012 | Hennig | 29/889.7 |

FOREIGN PATENT DOCUMENTS

| | | | |
|---|---|---|---|
| JP | 62-271700 | A | 11/1987 |
| JP | 3-7461 | U | 1/1991 |
| JP | 4-47263 | A | 2/1992 |
| JP | 7-290222 | A | 11/1995 |
| JP | 2000-136702 | A | 5/2000 |
| JP | 2005-207268 | A | 8/2005 |
| JP | 2006-159402 | A | 6/2006 |

* cited by examiner

*Primary Examiner* — David B Jones

(74) *Attorney, Agent, or Firm* — Drinker Biddle & Reath LLP

(57) ABSTRACT

First, a nozzle insertion process in which a nozzle is inserted into a water cooling hole having a small diameter which is provided in a back of a mold is performed. Then, an injection process in which a mixed flow of air having a pressure ranging from 0.1 MPa to 1.0 MPa with an injection particle is jetted from a leading end of a nozzle to a distal portion of the water cooling hole. As a result, a shot peening process is performed on the distal portion of the water cooling hole.

16 Claims, 9 Drawing Sheets

(A)

(B)

(A)

(B)

SHOT PROCESSING METHOD AND SHOT PROCESSING DEVICE

TECHNICAL FIELD

The present invention relates to a shot processing method and a shot processing device.

BACKGROUND ART

Conventionally, a shot processing method for performing a shot peening process on a surface of a cooling water passage provided in a mold is known (see, for example, Patent Literature 1 below).

CITATION LIST

Patent Literature

[Patent Literature 1] Japanese Patent Laid-Open Publication No. H7-290222

SUMMARY OF INVENTION

Technical Problem

However, since deflation of air flowing into a water cooling hole having a small diameter is degraded when a shot peening process is performed on the water cooling hole having a small diameter, it is not considered possible for a speed of an injection particle injected with the air to reach a desired speed. As a result, effects of the shot peening process are not considered to be sufficiently obtainable at a distal portion of the water cooling hole having a small diameter.

A shot processing method and a shot processing device capable of sufficiently obtaining the effects of the shot peening process at the distal portion of the water cooling hole having a small diameter are desired in the art.

Solution to Problem

A shot processing method according to an aspect of the present invention is a shot processing method for performing a peening process by injecting an injection particle from a nozzle, the method including: a nozzle insertion process of inserting the nozzle into a water cooling hole which is provided in a back of a mold and whose distal portion is closed; and an injection process of injecting a mixed flow of air having a pressure ranging from 0.1 MPa to 1.0 MPa with the injection particle from a leading end of the nozzle to the distal portion of the water cooling hole, the injection process being performed after the nozzle insertion process.

In the method, shot processing is performed on the distal portion of the water cooling hole by a nozzle which injects the injection particle from the leading end being inserted into the water cooling hole having a small diameter. Therefore, the injection particle injected at a high speed from the leading portion of the nozzle comes in contact with the distal portion of the water cooling hole without slowing down.

In an embodiment, an outer diameter of the nozzle may range from 2 mm to 5 mm. With the nozzle, the injection particle is injected at a high speed from the leading portion of the nozzle and comes in contact with the distal portion of the water cooling hole having a small diameter without slowing down.

In an embodiment, the injection particle may be a superhard shot material. By using the superhard shot material having a higher specific gravity than a general iron-based injection particle, the kinetic energy of the superhard shot material injected from the leading portion of the nozzle becomes higher in comparison with the case in which a general iron-based injection particle is injected. As a result, a force applied to the distal portion increases in comparison with the case in which the general iron-based injection particle is used, by the superhard shot material coming in contact with the distal portion of the water cooling hole.

In an embodiment, nominal hardness (Rockwell hardness) of the injection particle may range from HRA 89 to HRA 93, and the specific gravity may range from 14.8 to 15.4. By using a superhard shot material whose nominal hardness ranging from HRA 89 to HRA 93 and whose specific gravity is twice the specific gravity of the general iron-based injection particle or more, the force applied to the distal portion generated when the superhard shot material comes in contact with the distal portion of the water cooling hole further increases.

In an embodiment, in the injection process, the nozzle may reciprocate along the water cooling hole while rotating about an axial center of the nozzle. When the nozzle reciprocates along the water cooling hole while rotating about an axial center of the nozzle, the injection particle injected from the leading portion of the nozzle comes in contact with the surface of the sidewall of the water cooling hole. As a result, the tool mark formed in the sidewall of the water cooling hole when the water cooling hole is formed in the mold can be eliminated (the tool mark is crushed by the injection particle).

In an embodiment, the shot processing method may further include a process of using a nozzle having a reflection member attached to a leading end thereof, reflecting the injection particle using the reflection member, and injecting the injection particle on a sidewall of the water cooling hole, in the injection process. Through this process, the injection particle is reflected by the reflection member attached to the leading end of the nozzle and comes in contact with the sidewall of the water cooling hole.

In an embodiment, the injection process may be performed until the tool mark disappears uniformly. Through this process, the tool mark formed in the sidewall of the water cooling hole when the water cooling hole is formed in the mold is uniformly eliminated (the tool mark is uniformly crushed by the injection particle).

In an embodiment, the mold may be for die casting and a material thereof may be hot die steel. In this case, high stress is generated at the time of die casting molding, and the injection particle injected at a high speed from the leading portion of the nozzle comes in contact with the distal portion of the water cooling hole formed in the mold in which hot die steel, which is a material having a high hardness, is used, without slowing down.

A shot processing method according to another aspect of the present invention is a shot processing method for performing a peening process by injecting an injection particle from a nozzle, the method including: a determination process of determining presence or absence of a tool mark in a surface of an inner wall of a water cooling hole which is provided on a back of a mold and whose distal portion is closed; and an injection process of performing shot processing on the surface of the inner wall of the water cooling hole under a shot condition for eliminating the tool mark in the surface of the inner wall of the water cooling hole when a determination result of the determination process indicates presence of the tool mark.

According to the method, first, presence or absence of a tool mark in the surface of the water cooling hole of the mold is determined in the determination process. Then, in the injection process, when the determination result of the determination process indicates the presence of the tool mark, shot processing is performed on the surface of the water cooling hole of the mold under a shot condition for eliminating the tool mark in the surface of the water cooling hole of the mold. Thus, it is possible to prevent or suppress generation of cracks since concentration of stress on the tool mark portion can be prevented by removing the tool mark in the surface of the water cooling hole of the mold.

In an embodiment, the determination process may include determining the presence or the absence of the tool mark in the surface of the inner wall of the water cooling hole using an eddy current sensor inserted into the water cooling hole. Through this process, the presence or the absence of the tool mark in the surface of the water cooling hole of the mold is determined using the eddy current sensor inserted into the water cooling hole. Therefore, a simple and easy determination can be made.

A shot processing device according to still another aspect of the present invention performs shot processing on the water cooling hole formed in the mold using the above shot processing method. In the device, a shot peening process is performed on the water cooling hole using the above shot processing method. Therefore, the injection particle injected at a high speed from the leading portion of the nozzle comes in contact with the distal portion or the sidewall of the water cooling hole without slowing down.

A shot processing device according to still another aspect of the present invention includes a hood including an injection room therein; a manipulation means which is provided inside the injection room and inserts a nozzle into a water cooling hole having a small diameter formed in a back of the mold; an injection particle tank which stores an injection particle; a mixing unit which mixes the injection particle supplied from the injection particle tank with air having pressure ranging from 0.1 MPa to 1.0 MPa; and a hose which connects the mixing unit with the nozzle.

In the device, shot processing is performed on the distal portion of the water cooling hole by the nozzle which injects the injection particle from the leading end being inserted into the water cooling hole having a small diameter. Therefore, the injection particle injected at a high speed from the leading portion of the nozzle comes in contact with the distal portion of the water cooling hole without slowing down.

In an embodiment, the manipulation means may have dust durability. Through this configuration, it is possible to prevent malfunction of the manipulation means due to dust generated at the time of shot processing.

Advantageous Effects of Invention

According to various aspects and the embodiment described above, the shot processing method and the shot processing device capable of sufficiently obtaining effects of a shot peening process at a distal portion of a water cooling hole having a small diameter are provided.

DESCRIPTION OF EMBODIMENTS (Shot processing method) A shot processing method according to an embodiment will be described with reference to FIGS. 1 to 7.

Figure 1:
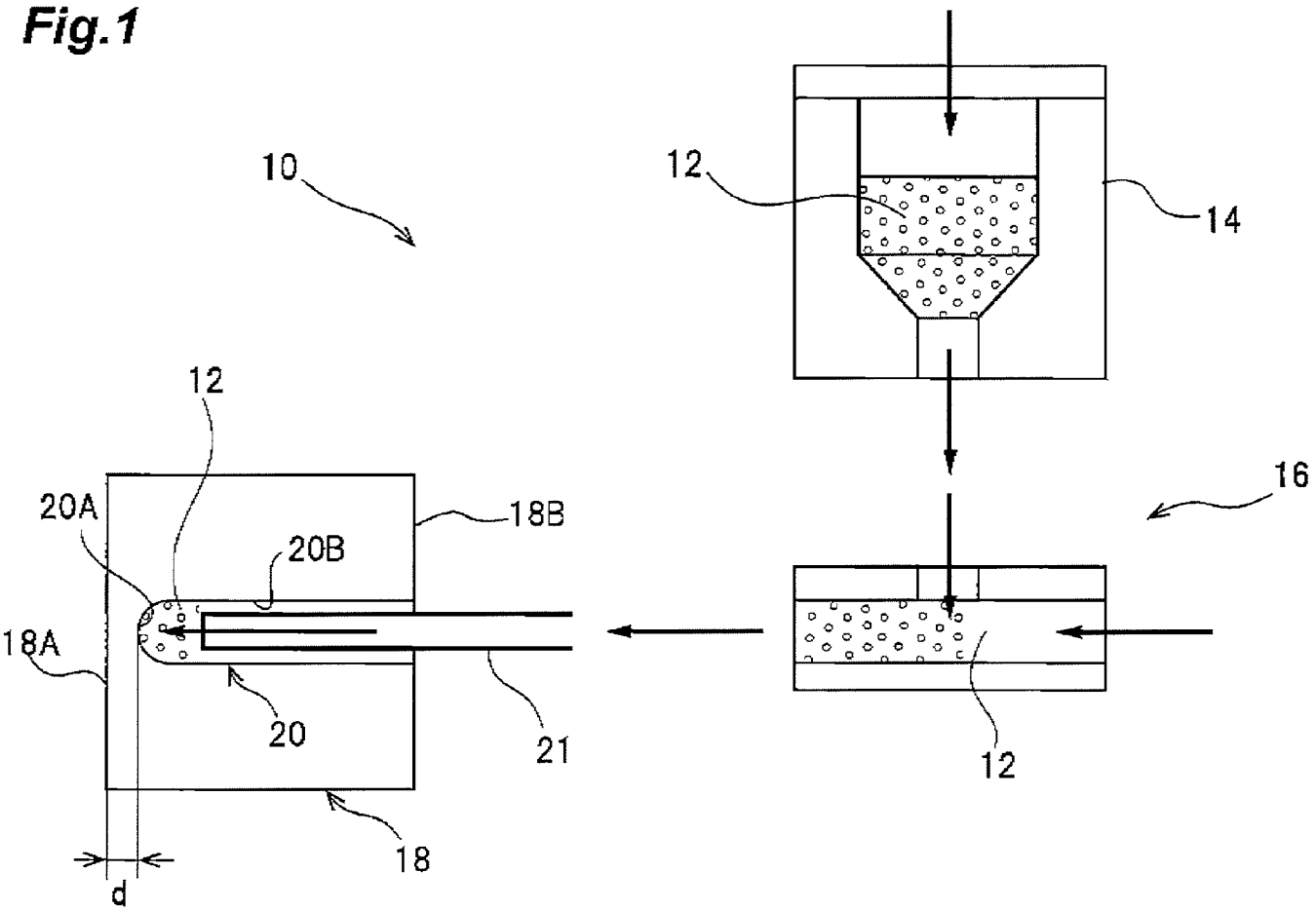
FIG. 1 is a schematic view illustrating a shot peening device for performing a shot processing method.

A schematic view of a shot peening device 10 for performing a shot processing method according to the present embodiment is illustrated in FIG. 1. As illustrated in FIG. 1, the shot peening device 10 of the present embodiment includes an injection particle 12, a tank (injection particle tank) 14 which stores this injection particle 12, and a mixing unit 16 which mixes the injection particle 12 supplied from this tank 14 with high pressure air. Further, the shot peening device 10 includes a nozzle 21 for injecting the injection particle 12 onto a water cooling hole 20 having a small diameter formed in a back 18B of a mold 18. Hereinafter, the injection particle 12, the mixing unit 16, and the nozzle 21 will first be described, and the mold 18 which is a processed target and the water cooling hole 20 formed in the mold 18 will then be described. Finally, a shot processing method for the water cooling hole 20 that is a primary portion of the present embodiment will be described.

(Injection particle) A cemented carbide having nominal hardness (Rockwell hardness) of, for example, HRA 89 to HRA 93 is used as the injection particle. In the present embodiment, a superhard shot material formed of cemented carbide whose bonding phase component is Co and whose nominal hardness is HRA 89 or more may be adopted as an example of the injection particle 12. Further, an average particle size of the injection particle 12 may be 100 μm. Further, a specific gravity of this injection particle 12 may range from 14.8 to 15.4, and in the shot peening device 10 of the present embodiment, the injection particle 12 having a higher specific gravity than a specific gravity (about 7.4) of a general iron-based injection particle is used. Further, a peening effect is insufficient in an injection particle whose nominal hardness is less than HRA 89 and whose specific gravity is less than 14.8, and it is difficult to produce an injection particle whose HRA is higher than 93 and whose specific gravity is higher than 15.4. Further, a particle size in which a cumulative weight obtained by sequential summation in ascending order of particle size of the injection particle 12 is 50% of a total weight is used as an average particle size of the injection particle.

(Mixing unit 16) The injection particle 12 stored in the tank 14 and high pressure air supplied from a compressor, which is not illustrated, are mixed in the mixing unit 16. Pressure of the air in this mixing unit 16 is 0.1 MPa or more (gauge pressure). The pressure of the air is 0.1 to 1.0 MPa, and preferably, 0.1 to 0.4 MPa. Further, when the pressure of the air is less than 0.1 MPa, the peening effect is insufficient, and when the pressure of the air exceeds 1.0 MPa, a compression air source (compressor) having a high pressure specification is used and cost of the peening process increases.

(Nozzle 21) The nozzle 21 is formed in a pipe shape with an outer diameter ranging from 2 mm to 5 mm (and an inner diameter ranging from 1.5 mm to 4 mm). A length and an outer diameter of the nozzle 21 are appropriately selected in consideration of a depth and an inner diameter of the water cooling hole 20 formed in the back 18B of the mold 18. Further, this nozzle 21 is connected to the mixing unit 16 through a connection tool, which is not illustrated.

(Mold 18 and water cooling hole 20) The mold 18 is formed using hot die steel, and a design surface 18A has a shape along a product produced by the mold 18. Further, the water cooling hole 20 having a small diameter whose distal portion 20A is closed is formed in the back 18B (a surface opposite to the design surface 18A) of the mold 18. An inner diameter of this water cooling hole 20 is about 3 mm to 10 mm. Further, a hardness of a surface of the mold is improved by performing a nitriding process on the mold 18.

Incidentally, when a large die casting product is produced by the mold 18, the mold 18 for die casting necessarily becomes large. Further, when production time per cycle is shortened, it is necessary to rapidly cool a material of a product injected into the mold 18. As a result, it is necessary to shorten a distance between the distal portion 20A of the water cooling hole 20 and the design surface 18A. Therefore, in the present embodiment, the distance d between the distal portion 20A of the water cooling hole 20 and the design surface 18A is set to about 1 mm.

For the mold which is a shot processing target of the present embodiment, a mold exposed to a high temperature and also exposed to a cooling action by cooling the mold using a water cooling hole provided on a back thereof becomes the target. For example, a die casting mold, a hot forging mold, or the like is considered as a concrete example.

Figure 2:
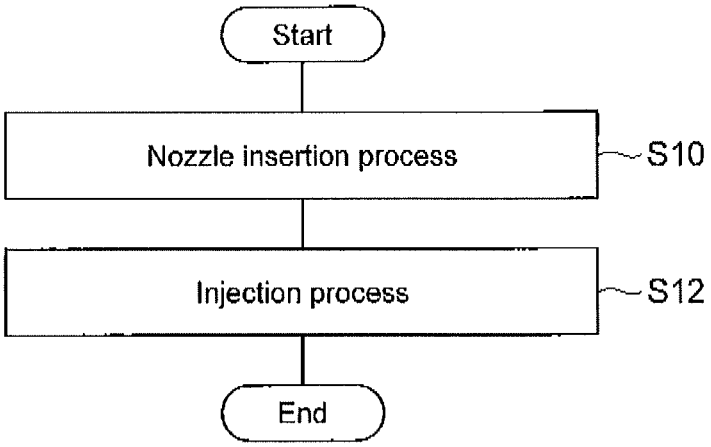
FIG. 2 is a flowchart illustrating the shot processing method.
Figure 3:
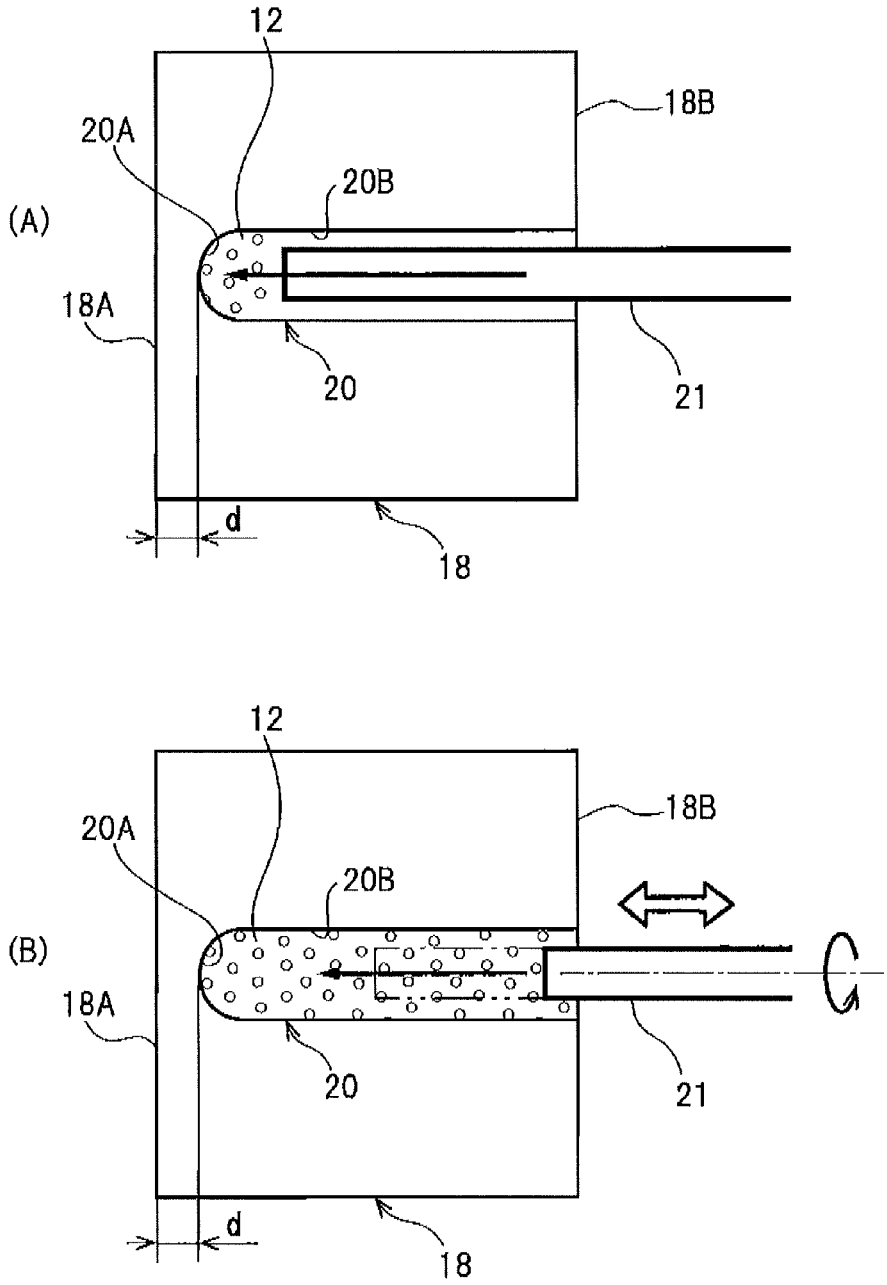
FIG. 3(A) is an enlarged cross-sectional view illustrating a nozzle insertion process.
FIG. 3(B) is an enlarged perspective diagram illustrating an injection process.
Figure 4:
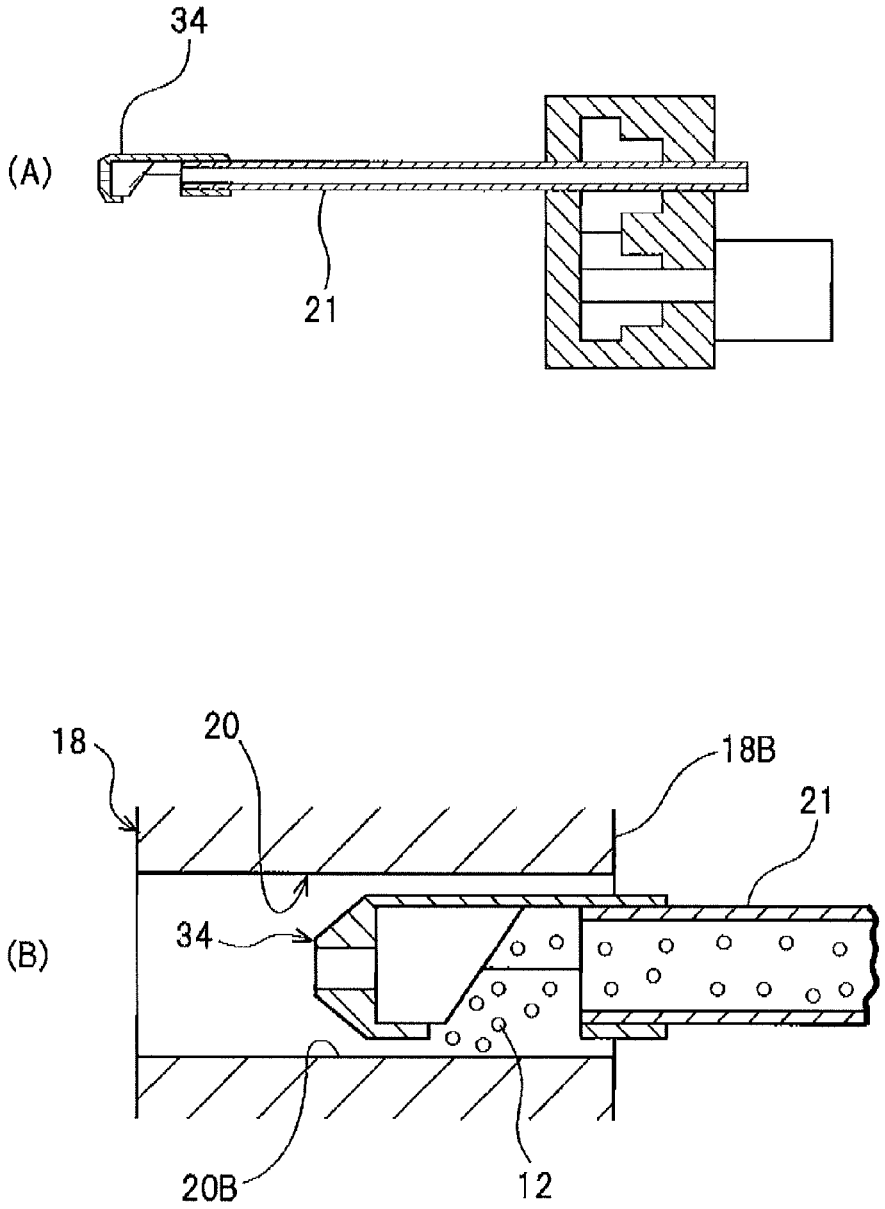
FIGS. 4(A) and (B) are conceptual diagrams illustrating a mechanism in which a reflection member which reflects some of an injection particle injected from a leading end of a nozzle is provided in the leading end of the nozzle.

(Shot processing method) FIG. 2 is a flowchart illustrating a shot processing method. First, a nozzle insertion process is performed, as illustrated in FIG. 2 (S10). In the process of S10, the nozzle 21 is first inserted into the water cooling hole 20 having a small diameter provided in the back 18B of the mold 18, as illustrated in FIG. 3(A). When the process of S10 ends, the process proceeds to an injection process (S12). In the process of S12, a mixed flow of the air having a pressure of 0.1 MPa or more and the injection particle 12 is jetted from a leading end of the nozzle to the distal portion 20A of the water cooling hole 20. As a result, the shot peening process is performed on the distal portion 20A of the water cooling hole 20.

Further, in the shot processing method of the present embodiment, the nozzle 21 reciprocates along the water cooling hole 20 while rotating about the axial center of the nozzle 21 in the injection process, as illustrated in FIG. 3(B).

Further, in the shot processing method of the present embodiment, the nozzle 21 including a reflection member 34 provided on its leading end for reflecting the injection particle 12 injected from the leading end of the nozzle 21 toward a sidewall 20B of the water cooling hole 20 may be used, as illustrated in FIGS. 4(A) and (B). In this case, the nozzle 21 reciprocates along the water cooling hole 20 while rotating about the axial center of the nozzle 21. Further, the reflection member 34 may be a member including an inclined surface intersecting an injection direction of the injection particle 12. For example, a reflection member illustrated in FIG. 1 of Japanese Patent Laid-Open No. 2002-239909 or FIG. 3 of Japanese Patent Laid-Open No. 2003-311621 may be used. When the process of S12 ends, the shot processing method illustrated in FIG. 2 ends.

The shot processing method illustrated in FIG. 2 ends as described above. Effects of the shot peening process can be sufficiently obtained at the distal portion 20A of the water cooling hole 20 having a small diameter by executing the shot processing method illustrated in FIG. 2. Further, when the water cooling hole is formed through drill processing, electro-discharge machining, or the like, a tool mark (irregularity) that is a scratch portion may be formed in a surface of the inner wall of the water cooling hole. Since the tool mark formed in the sidewall (inner wall) of the water cooling hole 20 can be eliminated using the nozzle 21 including the reflection member 34, it is possible to prevent the mold 18 from being damaged from the tool mark as a starting point.

Figure 5:
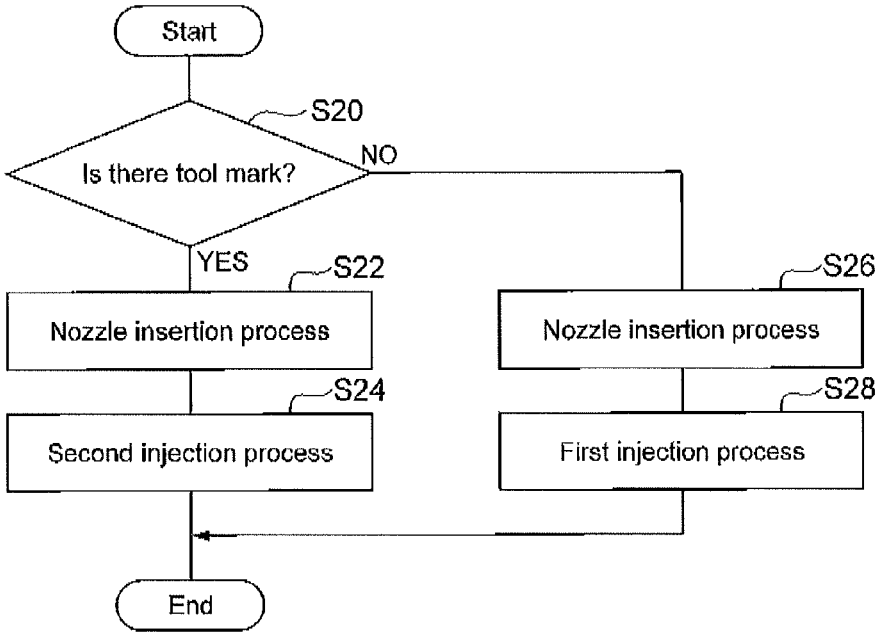
FIG. 5 is a flowchart illustrating a shot processing method when presence or absence of a tool mark is considered.
Figure 6:
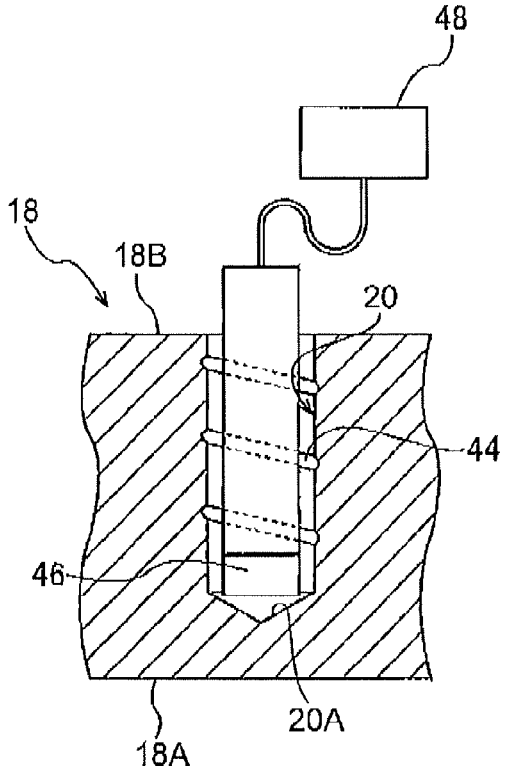
FIG. 6(A) is an enlarged cross-sectional view illustrating a determination process.
FIG. 6(B) is an enlarged perspective diagram illustrating a second injection process.
Figure 6:
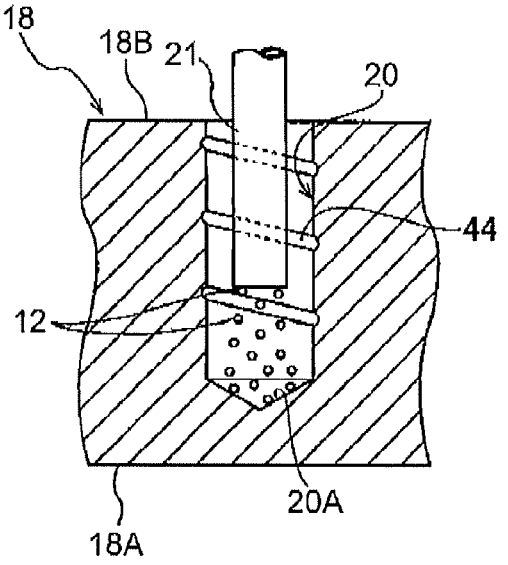
Figure 7:
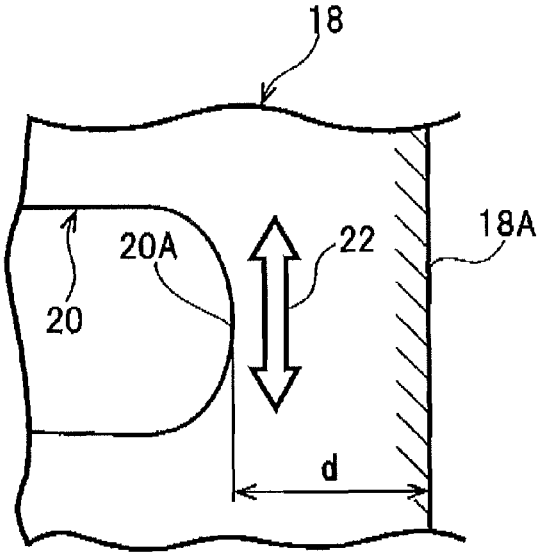
FIG. 7(A) is an enlarged cross-sectional view schematically illustrating tensile stress generated at a distal portion of a water cooling hole.
FIG. 7(B) is a graph illustrating compressive residual stress of tensile stress generated at the distal portion of the water cooling hole.
Figure 7:
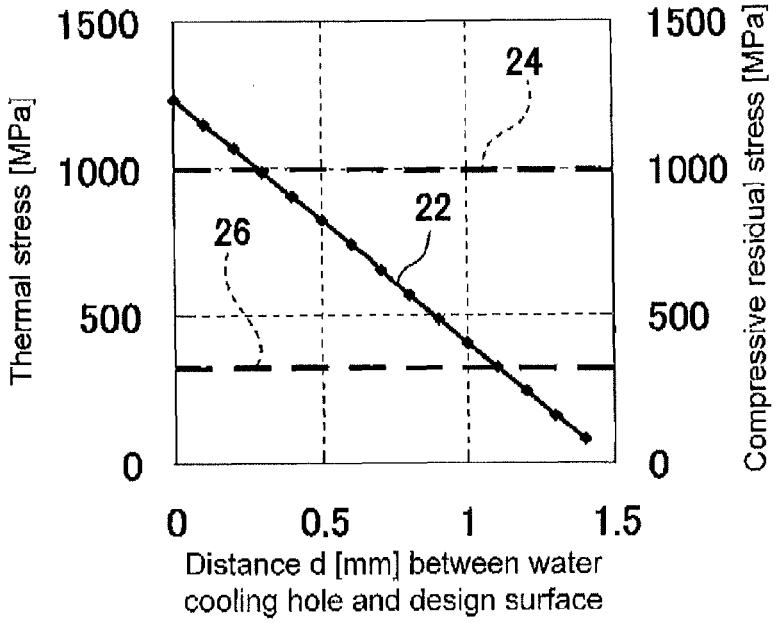

Next, a shot processing method when presence or absence of the tool mark is considered will be described. FIG. 5 is a flowchart illustrating a shot processing method when presence or absence of the tool mark is considered. As illustrated in FIG. 5, a process of determining presence or absence of the tool mark is first performed (S20). In the process of S20, an eddy current sensor 46 is inserted into the water cooling hole 20 formed in the back 18B of the mold 18 in the shot processing method of the present embodiment, as illustrated in FIG. 6(A). Presence or absence of the tool mark 44 in the surface (the inner surface) of the inner wall of the water cooling hole 20 of the mold 18 is then determined by a determination unit 48 using the eddy current sensor 46 (in a broad sense, in non-destructive inspection using an electromagnetic scheme).

The eddy current sensor 46 is configured to be able to generate a high frequency magnetic field. An eddy current is generated in the surface of the inner wall of the water cooling hole 20 of the mold 18 due to the high frequency magnetic field generated by the eddy current sensor 46. Here, when there is the tool mark 44 and when there is no tool mark 44, a passage of the eddy current becomes different and a passage of a magnetic flux due to the eddy current becomes different. As a result, since an impedance of a coil of the eddy current sensor 46 also becomes different, the eddy current sensor 46 outputs a measurement signal according to the presence or absence of the tool mark 44 to the determination unit 48. The determination unit 48 determines the presence or absence of the tool mark 44 based on the measurement signal from the eddy current sensor 46. Thus, it is possible to easily determine the presence or absence of the tool mark 44 using the eddy current sensor 46. When the determination process ends, the eddy current sensor 46 is withdrawn and retracted from the water cooling hole 20.

When a determination result of the determination process shown in S20 indicates that there is the tool mark, the process proceeds to a nozzle insertion process (S22). The process of S22 is similar to the process of S10 of FIG. 2, and the nozzle 21 is inserted into the water cooling hole 20 having a small diameter provided in the back 18B of the mold 18. When the process of S22 ends, the process proceeds to a second injection process (S24).

In the process of S24, the nozzle 21 illustrated in FIG, 6(B) is inserted into the water cooling hole 20, and the injection particle is jetted (shot processing) from the leading end of the nozzle 32 to the tool mark 44 in the surface of the water cooling hole 20 of the mold 18 together with compressed air. This shot processing is performed under a shot condition for eliminating the tool mark 44 in the surface of the inner wall of the water cooling hole 20 of the mold 18. When the process of S24 ends, the shot processing method illustrated in FIG. 5 ends.

On the other hand, when the determination result of the determination process shown in S20 indicates that there is no tool mark, the process proceeds to a nozzle insertion process (S26). The process of S26 is similar to the process of S10 of FIG. 2, and the nozzle 21 is inserted into the water cooling hole 20 having a small diameter provided in the back 18B of the mold 18. When the process of S26 ends, the process proceeds to a first injection process (S28).

In the process of S28, for example, the nozzle 21 illustrated in FIG. 3(B) is inserted into the water cooling hole 20, and a mixed flow of the air and the injection particle 12 is jetted from the leading end of the nozzle to the distal portion 20A of the water cooling hole 20. As a result, the shot peening process is performed on the distal portion 20A of the water cooling hole 20. Further, the nozzle 21 reciprocates along the water cooling hole 20 while rotating the axial center of the nozzle 21. When the process of S28 ends, the shot processing method illustrated in FIG. 5 ends.

The shot processing method illustrated in FIG. 5 ends as described above. Since the presence or absence of the tool mark 44 can be confirmed and the tool mark 44 in the surface of the inner wall of the water cooling hole 20 of the mold 18 can be eliminated when there is the tool mark 44 to prevent concentration of stress on a portion of the tool mark 44 by performing the shot processing method illustrated in FIG. 5, it is possible to efficiently perform prevention or suppression of generation of cracks.

Incidentally, the design surface 18A of the mold 18 is heated to a high temperature by a material of a product being injected. Further, the water cooling hole 20 of the mold 18 is cooled to a low temperature by the flow of the cooling water. As a result, a temperature gradient is generated between the design surface 18A of the mold 18 and the water cooling hole 20. Particularly, in the present embodiment, since a distance between the distal portion 20A of the water cooling hole 20 and the design surface 18A is set to about 1 mm, the temperature gradient in a corresponding portion becomes extreme. As a result, tensile stress is generated at the distal portion 20A of the water cooling hole 20 (thermal stress 22), as illustrated in FIG. 7(A). When the distal portion 20A of the water cooling hole is placed under a corrosion environment, such as cooling water, in a state in which the tensile stress (the thermal stress 22) is generated at the distal portion 20A of the water cooling hole 20, stress corrosion cracks are considered to be generated at the distal portion 20A of the water cooling hole 20.

Therefore, when the tensile stress due to the thermal stress 22 is generated at the distal portion 20A of the water cooling hole 20, confirmation as to whether compressive residual stress is generated at the distal portion 20A of the water cooling hole 20 is performed. This will be described below.

First, the tensile stress (the thermal stress 22) generated at the distal portion 20A of the water cooling hole 20 was calculated in consideration of the distance d between the distal portion 20A of the water cooling hole 20 and the design surface, the difference in temperature between the distal portion 20A of the water cooling hole 20 and the design surface, the material of the mold 18, and the like. The thermal stress 22 calculated by this calculation is illustrated in FIG. 7(B) (see a left axis). Further, in the present embodiment, the thermal stress 22 is calculated by multiplying a value obtained by multiplying a Young's modulus and a linear expansion coefficient of the material of the mold by the difference in temperature between the distal portion 20A of the water cooling hole 20 and the design surface 18A. Further, in the present embodiment, the calculation was performed at each distance d between the distal portion 20A of the water cooling hole 20 and the design surface.

Then, the compressive residual stress generated at the distal portion 20A of the water cooling hole 20 by the shot peening process being performed was measured using an X-ray stress measurement device. The compressive residual stress 24 measured by this measurement device is illustrated in FIG. 7(B) (see a right axis). Further, the compressive residual stress 26 is residual stress generated at the distal portion 20A of the water cooling hole 20 in a state before the shot peening process is performed. Further, although the residual stress was analyzed using a $\sin^2 \Psi$ method in the present embodiment, other analysis methods may be used.

If the compressive residual stress 24 measured by the measurement device is a value exceeding the thermal stress 22 calculated by the calculation on this graph, the stress corrosion cracks are difficult to generate. Incidentally, in the present embodiment, the distance between the distal portion 20A of the water cooling hole 20 and the design surface 18A is set to about 1 mm, but it was confirmed that the compressive residual stress 24 measured by the measurement device is a value exceeding the thermal stress 22 calculated by the calculation in FIG. 7(B).

(Operation and Effects of the Present Embodiment)

Next, operation and effects of the present embodiment will be described.

In the shot processing method of the present embodiment, the shot peening process is performed on the distal portion 20A of the water cooling hole 20 by the nozzle 21, which injects the injection particle 12 from the leading end, being inserted into the water cooling hole 20 having a small diameter. Therefore, the injection particle 12 injected at a high speed from the leading end of the nozzle 21 comes in contact with the distal portion 20A of the water cooling hole 20 without substantially slowing down. In other words, in the present embodiment, it is possible to sufficiently obtain effects of the shot peening process at the distal portion 20A of the water cooling hole 20 having a small diameter.

Further, in the present embodiment, a superhard shot material having a higher specific gravity than a general iron-based injection particle is used. Therefore, kinetic energy of the injection particle 12 injected from the leading end of the nozzle 21 becomes higher in comparison with the case in which a general iron-based injection particle is injected. As a result, a force applied to the distal portion 20A increases in comparison with the case in which the general iron-based injection particle is used, by the injection particle 12 coming in contact with the distal portion 20A of the water cooling hole 20. In other words, in the present embodiment, it is possible to further obtain effects of the shot peening process at the distal portion 20A of the water cooling hole 20 having a small diameter.

Further, in the present embodiment, the nozzle 21 reciprocates along the water cooling hole 20 while rotating about the axial center of the nozzle 21. Further, the nozzle 21 having the reflection member 34 attached thereto reciprocates along the water cooling hole 20 while rotating about the axial center of the nozzle 21. Therefore, the injection particle 12 injected from the leading end of the nozzle 21 comes in contact with the sidewall 20B in the surface of the water cooling hole 20. As a result, the tool mark formed in the sidewall 20B of the water cooling hole 20 when the water cooling hole 20 is formed in the mold 18 can be eliminated (the tool mark is crushed by the injection particle 12). As a result, in the present embodiment, the mold 18 can be prevented from being damaged from the tool mark formed in the sidewall 20B of the water cooling hole 20 as a starting point. Further, this is more desirable since the starting point of the damage is not generated by the injection process being performed until the tool mark disappears uniformly.

Further, in the present embodiment, it was confirmed in the graph illustrated in FIG. 7(B) that the compressive residual stress 24 generated at the distal portion 20A of the water cooling hole 20 is higher than the tensile stress (the thermal stress 22) generated at the distal portion 20A of the water cooling hole 20. In other words, in the present embodiment, it is possible to suppress the stress corrosion cracks from being generated at the distal portion 20A of the water cooling hole 20.

Further, in the present embodiment, while the example in which the injection particle 12 is used has been described, the present invention is not limited thereto. As described above, any cemented carbide having a nominal hardness of HRA 89 to HRA 93 may be used as the injection particle. An injection particle to be used may be appropriately set in consideration of the hardness of the processed target, or the like. For example, an injection particle formed of VF-10, VF-20, VF-30, VF-40, VM-10, VM-20, VM-30, VM-40, VC-40, VU-40 or the like identified with material classification symbols determined by the Japan Cemented Carbide Tool Manufacturers' Association (http://www.jctma.jp/) may be used.

(Shot processing device) Next, the shot peening device 10 will be described as a shot processing device according to an embodiment with reference to FIGS. 8 and 9.

Figure 8:
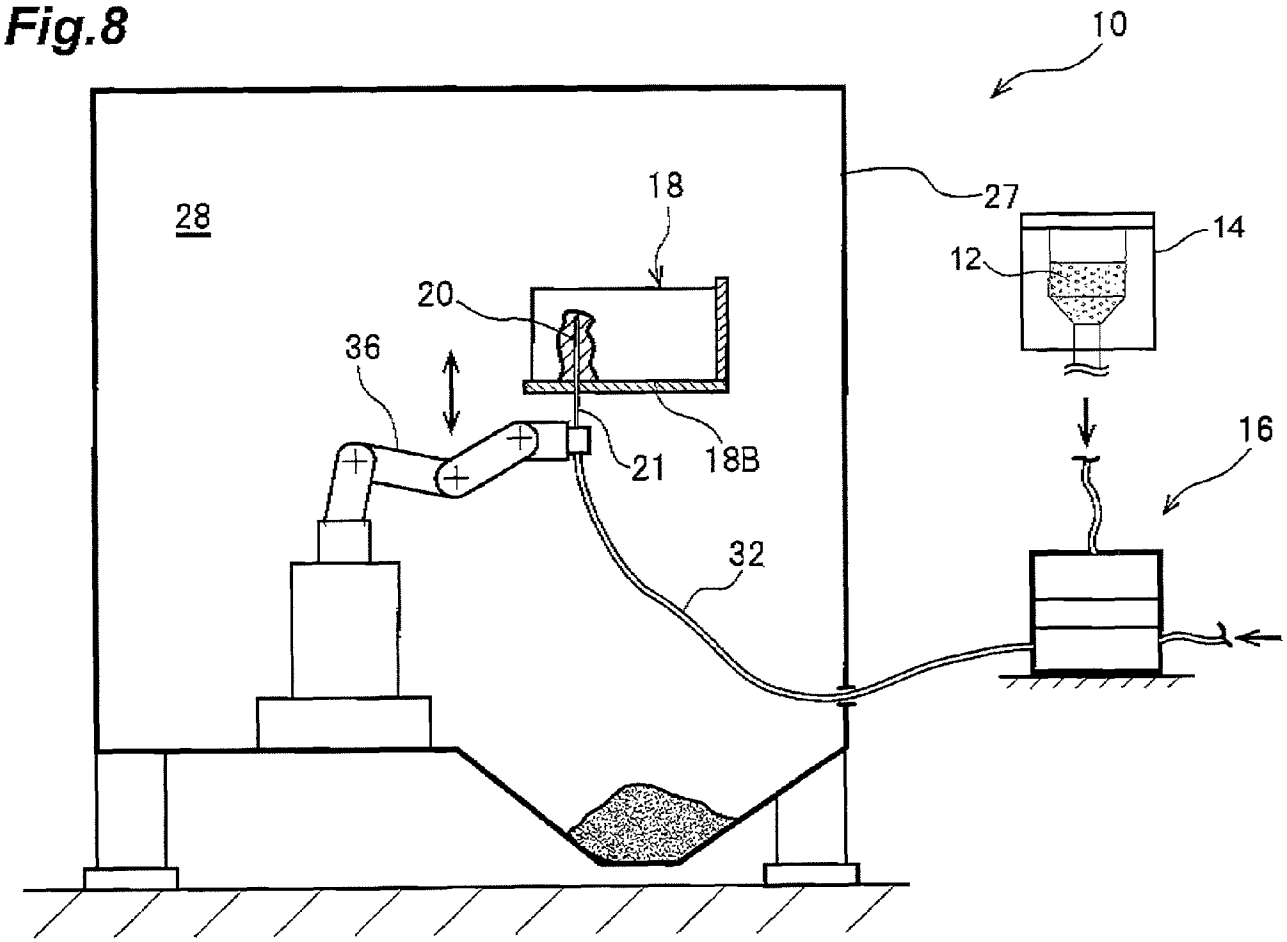
FIG. 8 is a side view illustrating a shot peening device.
Figure 9:
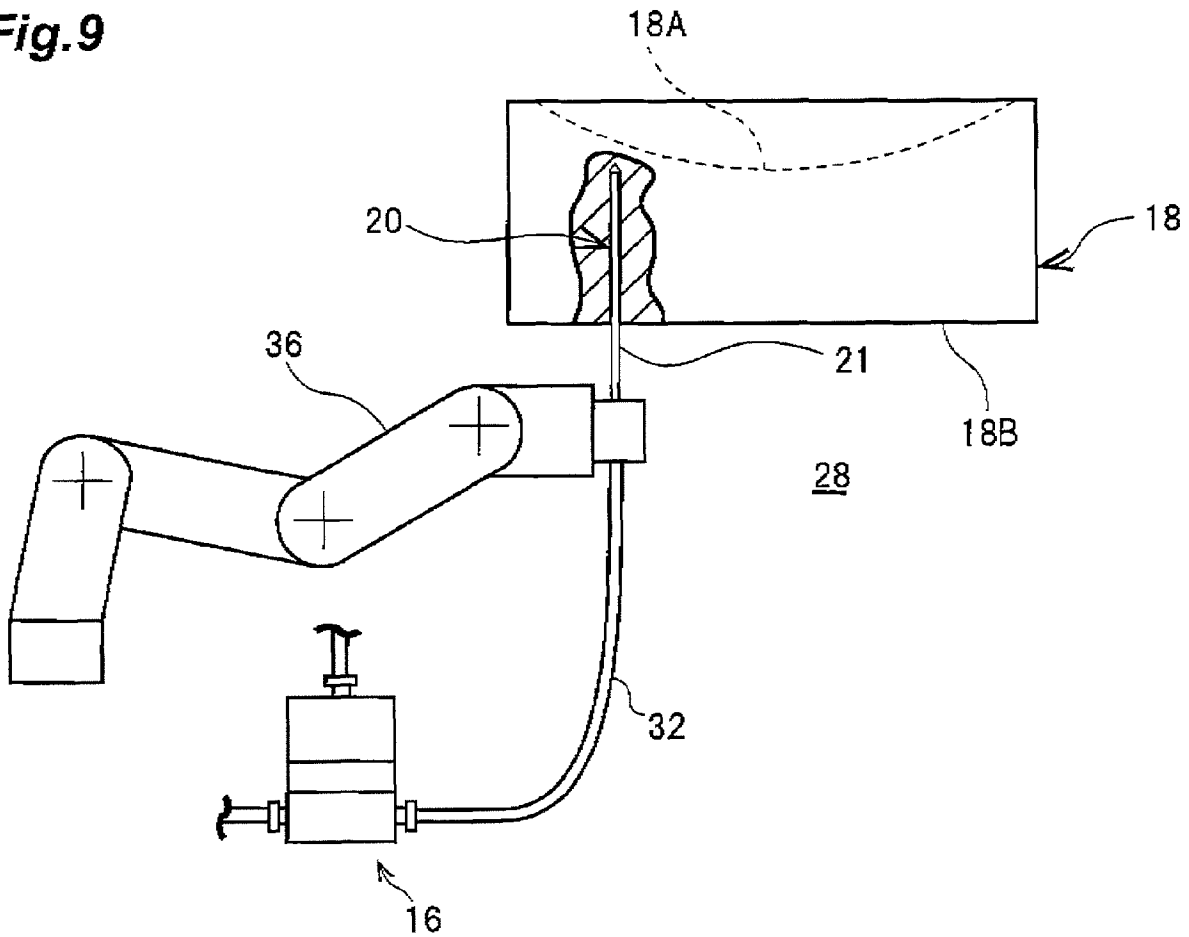
FIG. 9 is a schematic view illustrating an overview of the shot processing device.

The shot peening device 10 according to the present embodiment includes a hood 27 including an injection room 28 therein in which the injection particle 12 (see FIG. 1) is injected on the mold 18 (see FIG. 1), which is a processed target, and a robot arm 36 as a manipulation means provided inside this injection room 28 for inserting the nozzle 21 into the water cooling hole 20 having a small diameter formed in the back 18B of the mold 18, as illustrated in FIGS. 8 and 9. A seal material which suppresses entrance of dust into a bearing portion of this robot arm 36 is provided in the bearing portion. As a result, the robot arm 36 has dust durability. Further, the shot peening device 10 includes a tank 14 which stores the injection particle 12, a mixing unit 16 which mixes the injection particle 12 supplied from this tank 14 with air having a pressure of 0.1 to 1.0 MPa, and a hose 32 which connects this mixing unit 16 with the nozzle 21. Further, the shot peening device 10 includes a conveying device, which is not illustrated, which conveys the injection particle 12 after shot processing stored in a recess portion formed in a lower portion of the injection room 28, and dust or the like generated at the time of shot processing. Further, the injection particle or the like carried by the conveying device is divided into the reusable injection particle 12 and other dust or the like, and the reusable injection particle 12 is returned to the tank 14 again.

The nozzle insertion process, the injection process and the like illustrated in FIGS. 2 and 5 are performed in the injection room 28 of the shot peening device 10.

(Operation and Effects of the Present Embodiment)

Next, operation and effects of the present embodiment will be described.

In the shot peening device 10 of the present embodiment, the shot peening process is performed on the water cooling hole 20 through the nozzle insertion process and the injection process described above. Therefore, the injection particle 12 injected at a high speed from the leading end of the nozzle 21 comes in contact with the distal portion 20A of the water cooling hole 20 without slowing down. In other words, in the present embodiment, it is possible to sufficiently obtain effects of the shot peening process at the distal portion 20A of the water cooling hole 20 having a small diameter.

Further, in the shot peening device 10 of the present embodiment, the robot arm 36 has dust durability. Therefore, the robot arm 36 can be prevented from malfunctioning due to the dust generated at the time of shot processing.

Further, while the example in which the dust durability of the robot arm 36 is improved by providing the seal material in the bearing portion of the robot arm 36 has been described in the present embodiment, the present invention is not limited thereto. For example, the dust durability of the robot arm 36 may be improved by covering the robot arm 36 with a cover member. Further, a configuration in which dust can be prevented from entering the bearing portion by injecting high-pressure air from the periphery of the bearing portion of the robot arm 36 may be used. Thus, a scheme for improving the dust durability of the robot arm 36 may be appropriately set in consideration of an environment of the injection room 28 in which the robot arm 36 is provided, or the like.

While the embodiment of the present invention has been described above, it is understood that the present invention is not limited to the above and various other variations may be made without departing from the gist of the present invention.

REFERENCE SIGNS LIST

10 . . . Shot peening device (shot processing device), 12 . . . Injection particle, 14 . . . Tank, 16 . . . Mixing unit, 18 . . . Mold, 18B . . . Back, 20 . . . Water-cooling hole, 20A . . . Distal portion, 20B . . . Sidewall, 21 . . . Nozzle, 27 . . . Hood, 32 . . . Hose, 34 . . . Reflection member, 36 . . . Robot arm (manipulation means)

The invention claimed is:

1. A shot processing method of performing a peening process by injecting an injection particle from a nozzle, comprising:

inserting the nozzle into a water cooling hole provided in a back of a mold, the water cooling hole having a closed distal end portion; and after inserting the nozzle into the water cooling hole, injecting a mixed flow of air having a pressure ranging from 0.1 MPa to 1.0 MPa with the injection particle from a leading end of the nozzle to the distal portion of the water cooling hole while the nozzle reciprocates along the water cooling hole and rotates about an axial center of the nozzle.

2. The shot processing method according to claim 1, wherein an outer diameter of the nozzle ranges from 2 mm to 5 mm.

3. The shot processing method according to claim 1, wherein the injection particle is a superhard shot material.

4. The shot processing method according to claim 3, wherein nominal hardness of the injection particle ranges from HRA 89 to HRA 93, and a specific gravity thereof ranges from 14.8 to 15.4.

5. The shot processing method according to claim 1, wherein the distal end portion of the nozzle is provided with a reflection member, and wherein, when injecting the mixed flow, the injection particle is reflected using the reflection member to inject the injection particle against a sidewall of the water cooling hole, in the injection process.

6. The shot processing method according to claim 1 claim, wherein the mixed flow is injected from the distal end of the nozzle until a tool mark disappears uniformly.

7. The shot processing method according to claim 1, wherein the mold is for die casting and a material thereof is hot die steel.

8. A shot processing method of performing a peening process by injecting an injection particle from a nozzle, comprising:

determining presence or absence of a tool mark in a surface of an inner wall of a water cooling hole provided on a back of a mold, the water cooling hole having a closed distal end portion; and performing shot processing on the surface of the inner wall of the water cooling hole and eliminating the tool mark in the surface of the inner wall while the nozzle reciprocates along the water cooling hole and rotates about an axial center of the nozzle, when a determination result indicates presence of the tool mark.

9. The shot processing method according to claim 8, wherein presence or absence of a tool mark is determined based on a signal from an eddy current sensor inserted into the water cooling hole.

10. The shot processing method according to claim 8, wherein the distal end of the nozzle is provided with a reflection member, and wherein, when performing shot processing and eliminating the tool mark, the injection particle is reflected using the reflection member to inject the injection particle against a sidewall of the water cooling hole.

11. A shot processing device comprising:

a hood including an injection room therein, the injection room configured to be capable of accommodation a mold the mold provided with a water cooling hole having a small diameter formed in a back of the mold:

an injection particle tank storing an injection particle, the injection particle arranged outside the injection room;

a mixing unit making a mixture obtained by mixing the injection particle supplied from the injection article tank with air having a pressure ranging from 0.1 MPa to 1.0 MPa , the mixing unit arranged outside the injection room;

a nozzle arranged inside the injection room;

a hose connecting the mixing unit with the nozzle; and a manipulation unit manipulating the nozzle, the manipulation unit provided inside the injection room, wherein the mixing unit inserts the nozzle into the water cooling hole and reciprocates the nozzle along the water cooling hole while rotating the nozzle about an axial center of the nozzle, and wherein the mixing unit supplies the mixture to the nozzle when the nozzle is inserted into the water cooling hole by the manipulation unit.

12. The shot processing device according to claim 11, wherein the manipulation unit has dust durability.

13. The shot processing device according to claim 11, wherein the distal end of the nozzle is provided with a reflection member reflecting the injection particle toward a sidewall of the water cooling hole.

14. A shot processing device comprising:

a hood including an injection room therein, the injection room configured to be capable of accommodating a mold, the mold provided with a water cooling hole having a small diameter formed in a back of the mold;

an injection particle tank storing an injection particle, the injection particle arranged outside the injection room;

a mixing unit making a mixture obtained by mixing the injection particle supplied from the injection particle tank with air having a pressure ranging from 0.1 MPa to 1.0 MPa, the mixing unit arranged outside the injection room;

a nozzle arranged inside the injection room;

a hose connected the mixing unit with the nozzle;

a manipulation unit manipulating the nozzle, the manipulation unit provided inside the injection room;

a sensor outputting a signal in accordance with presence or absence of a tool mark; and a determining unit determining presence or absence of a tool mark based on the signal from the sensor, wherein, when a determination result of the determining unit indicates presence of the tool mark, the manipulation unit inserts the nozzle into the water cooling hole and reciprocates the nozzle along the water cooling hole while rotating the nozzle about an axial center of the nozzle, thereby eliminating the tool mark in the surface of the inner wall of the water cooling hole, and wherein the mixing unit supplies the mixture to the nozzle when the nozzle is inserted into the water cooling hole by the manipulation unit.

15. The shot processing device according to claim 14, wherein the manipulation unit has dust durability.

16. The shot processing device according to claim 11, wherein the distal end of the nozzle is provided with a reflection member reflecting the injection particle toward a sidewall of the water cooling hole.

* * * * *